United States Patent [19]

Platt

[11] Patent Number: 4,469,155

[45] Date of Patent: Sep. 4, 1984

[54] APPARATUS FOR PEELING SMALL LOGS

[75] Inventor: Sterling B. Platt, Stamford, Conn.

[73] Assignee: Champion International Corporation, Stamford, Conn.

[21] Appl. No.: 450,014

[22] Filed: Dec. 15, 1982

[51] Int. Cl.[3] ..... B27C 7/04; B27L 5/00

[52] U.S. Cl. ..... 144/209 R; 82/40 R; 142/53

[58] Field of Search ..... 82/40 R; 142/48, 53, 142/55, 57; 144/209 R

[56] References Cited

U.S. PATENT DOCUMENTS

| | | | |
|---|---|---|---|
| 3,252,488 | 5/1966 | Molyneuk | 144/209 R |
| 3,455,351 | 7/1969 | Hayes | 144/209 R |
| 3,506,045 | 4/1970 | Bosco | 144/209 R |
| 3,513,891 | 5/1970 | Heth | 144/209 R |
| 3,672,416 | 6/1972 | Reed | 144/209 R |
| 4,342,348 | 8/1982 | Lichterwalter et al. | 82/40 R |

*Primary Examiner*—W. D. Bray

*Attorney, Agent, or Firm*—Evelyn M. Sommer; William W. Jones

[57] ABSTRACT

An apparatus is disclosed for peeling logs to produce veneer sheet. The apparatus utilizes concentric spindles and dogs to grip the ends of the logs being peeled with the outer spindle and dog being retractable away from the ends of the logs after the outer portion of the log has been peeled. The innermost dog gripping each end of the log is smaller in diameter than the spindle on which it is mounted so that a greater percentage of the log can be peeled by the apparatus. The apparatus is particularly useful for increasing the percentage of veneer sheet obtained by peeling small logs, i.e., logs having a diameter of ten inches or less.

6 Claims, 5 Drawing Figures

APPARATUS FOR PEELING SMALL LOGS

This invention relates to an apparatus, i.e., a lathe which is used for peeling logs to produce veneer sheet used for forming plywood or other forms of panels. The apparatus of this invention is particularly useful for increasing the percentage of veneer yielded from the peeling of a small log, i.e., a log having a diameter of ten inches or less.

Wood veneer is produced by peeling logs which are mounted in lathes and rotated in the lathe while knives are brought to bear against the outer surface of the log. The lathe generally includes a drive roll which contacts the outer surface of the logs and aids in rotating the log in the lathe after the log has been peeled to a certain diameter. The knives are steadily advanced toward the center of the log while the latter rotates, and the veneer sheet material peeled off of the log is drawn off of the lathe for further processing.

Log peeling lathes of the general type referred to above have been provided with sets of cooperating dogs which are mounted on driven spindles for rotational movement. The dogs are operable to pierce the ends of the logs to hold the latter in place during the peeling operation. It will be appreciated that the larger the log, the larger the dogs and spindles needed to hold the log properly as the log is rotated and peeled. This requirement is necessary because of the weight and tendency of the log to vibrate as it is being rotated during the peeling operation. It is also apparent that as the log is peeled, its size is reduced so that it no longer requires the larger dogs to properly hold it in place as peeling continues. In response to this lessening of dog size needed to support the ends of the log as peeling progresses, log peeling lathes have been developed in the prior art which utilize two or more concentric dogs mounted on two or more concentric spindles to grip the opposite ends of the log being peeled. When the peeling of the log has progressed to a predetermined point, i.e., to a diameter somewhat larger than the diameter of the largest and outermost of the concentric dogs and spindles, the outermost dog and spindle is retracted away from each end of the log leaving the inner dogs gripping the ends of the log. The outermost dogs are retracted far enough to leave clearance for the knives and knife carriage to continue to be fed toward the axis of the log without any danger of the knives or carriage contacting the retracted dogs and spindles. This type of concentric dog and spindle arrangement is shown in U.S. Pat. Nos. 3,252,488; 3,455,354; and 3,506,045. It should be noted that even though the size of the log decreases as it is being peeled, better support and log stability is provided when the innermost spindle is relatively large in diameter. In the prior art, the diameter of the dogs has always been equal to or larger than the diameter of the spindles on which the dogs are mounted. Thus a dilemma is presented in the prior art log peeling lathes relating to the trade-off between the need for proper and adequate support for the ends of the log being peeled which is best served by a larger diameter spindle, and the opposing desire to peel as much of the log as possible in order to maximize the production of veneer sheet, which is accomplished by a smaller diameter spindle in the prior art.

The apparatus of this invention realizes both objectives of adequate log support and maximized veneer sheet yield by utilizing a relatively large diameter spindle to which is secured a relatively small diameter dog. When a plurality of concentric spindles and dogs are used, only the innermost ones of the spindles and dogs may be as described above. The outer spindles and dogs may be of conventional construction. The relatively small diameter dog is preferably formed with a small diameter toothed end which is embedded in the end of the log. The dog also includes a small diameter shank which is secured to the end of the spindle and which projects beyond the end of the spindle. Thus the dog is a relatively small diameter member which is elongated to serve as an extension of the large diameter spindle. In the case of multiple coaxial spindles and dogs, the outer spindles and dogs will retract to approximately the end of the inner spindles so that the inner dog shanks will project beyond the ends of the outer dogs. The use of projecting dog shanks will provide the necessary clearance for the knife carriage to continue to be advanced toward the central axis of the log without the danger of contacting the outer spindles and dogs. By using the elongated projecting inner dogs, in the event that the knives or carriage accidentally contact the log supporting portion of the lathe, only the dogs, which are readily replaceable, will be damaged. The inner spindles are protected from damage since they never project into the path of the knives or carriage. Since the smaller diameter dogs are a minor component of the overall spindle-dog log support, the apparatus provides improved supporting of the log which is chiefly derived from the larger diameter spindle.

It is, therefore, an object of this invention to provide an improved apparatus for use in the peeling of logs whereby increased yield of wood veneer is obtained from relatively small logs.

It is a further object of this invention to provide an apparatus of the character described wherein satisfactory support of the ends of the logs is achieved during the peeling operation along with the improved veneer yield.

It is an additional object of this invention to provide an apparatus of the character described wherein support spindles of relatively larger diameter on the apparatus are fitted on their end surfaces with elongated projecting log-gripping dogs of relatively smaller diameter to allow the logs to be peeled to a smaller diameter core without sacrificing the supporting ability of the spindles.

These and other objects and advantages of the invention will become more readily apparent form the following detailed description of a preferred embodiment thereof when taken in conjunction with the accompanying drawings, in which.

Figure 1:
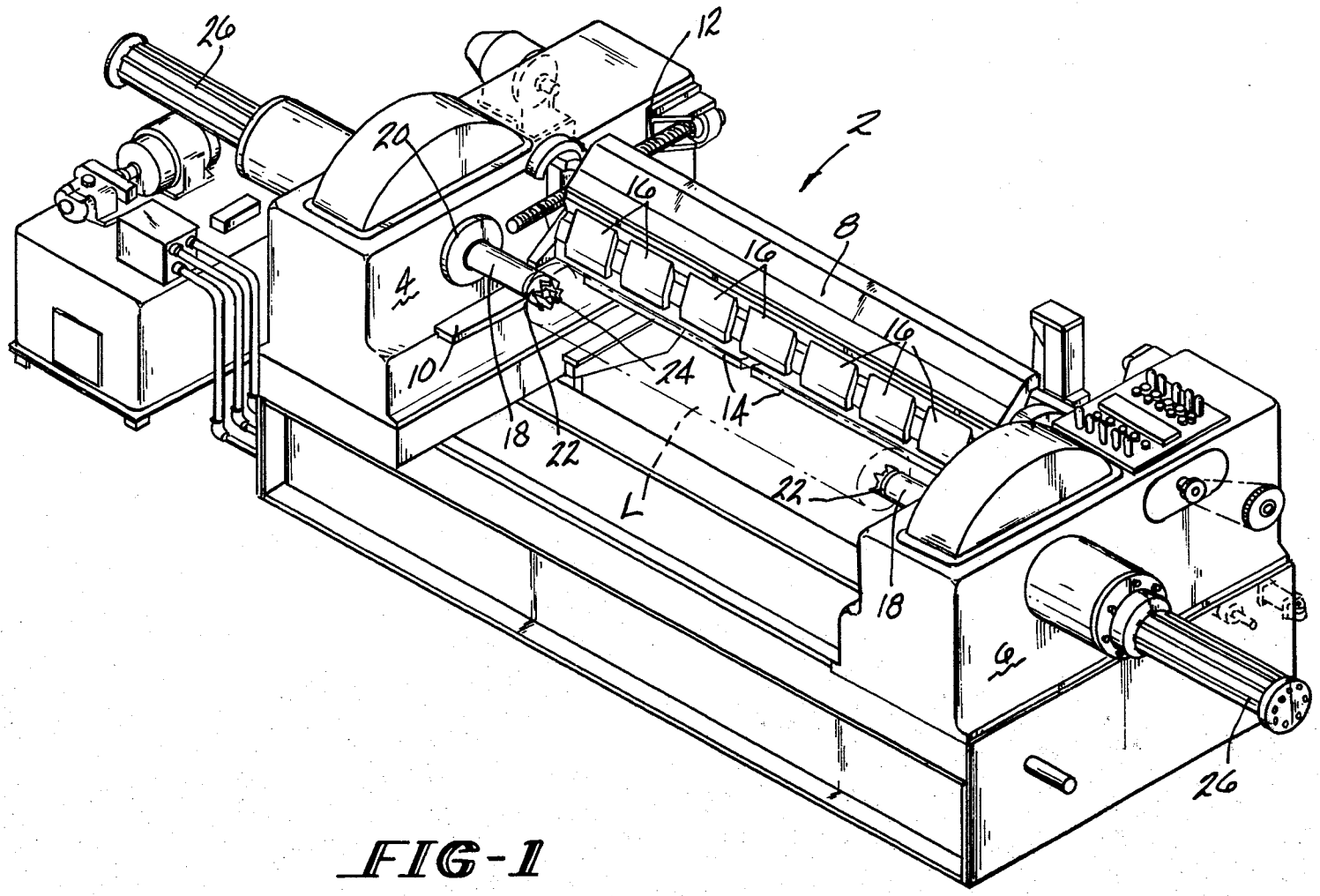
FIG. 1 is a perspective view of a log peeling lathe employing the improved log supporting members of this invention.

Referring now to the drawings, there is shown in FIG. 1 a perspective view of a log peeling lathe having log gripping dogs and support spindles formed in accordance with this invention. The later, denoted generally by the numeral 2, includes a pair of end portions 4 and 6 between which the log L (shown in phantom) to be peeled is positioned. The lathe 2 includes a carriage 8 extending between the end portions 4 and 6, which carriage 8 is movably mounted on a pair of tracks 10 (only one of which is shown). A screw drive 12 operates automatically to advance the carriage 8 toward the log L during the peeling operation. A pair of knives 14 are mounted on the carriage 8 as are a plurality of adjustable pressure or nose bars 16. The pressure bars 16 cooperate with the knives 14 to control the thickness of the veneer peeled off of the log L. Extending from each of the end portions 4 and 6 toward each other are the log supporting spindles. The lathe 2 is equipped with two sets of concentric spindles, with the outer spindle 18 of each set being shown in FIG. 1. As explained hereinafter, there is an inner spindle in each set also. The spindles 18 are mounted for driven rotational movement in bearings 20 mounted in the end portions 4 and 6 of the lathe 2. Mounted on the ends of the outer spindles 18 are toothed dogs 22 which are embedded in and engage the ends of the log L. Concentric with and within the confines of the outer dogs 22 are the inner dogs 24 which are mounted on the ends of the inner spindles and which are also embedded in and in engagement with the ends of the log L. Disposed on the outside of each end portion 4 and 6 of the lathe 2 are the spindle retraction mechanisms 26 into which the outer spindles 18 are retracted.

Figure 2:
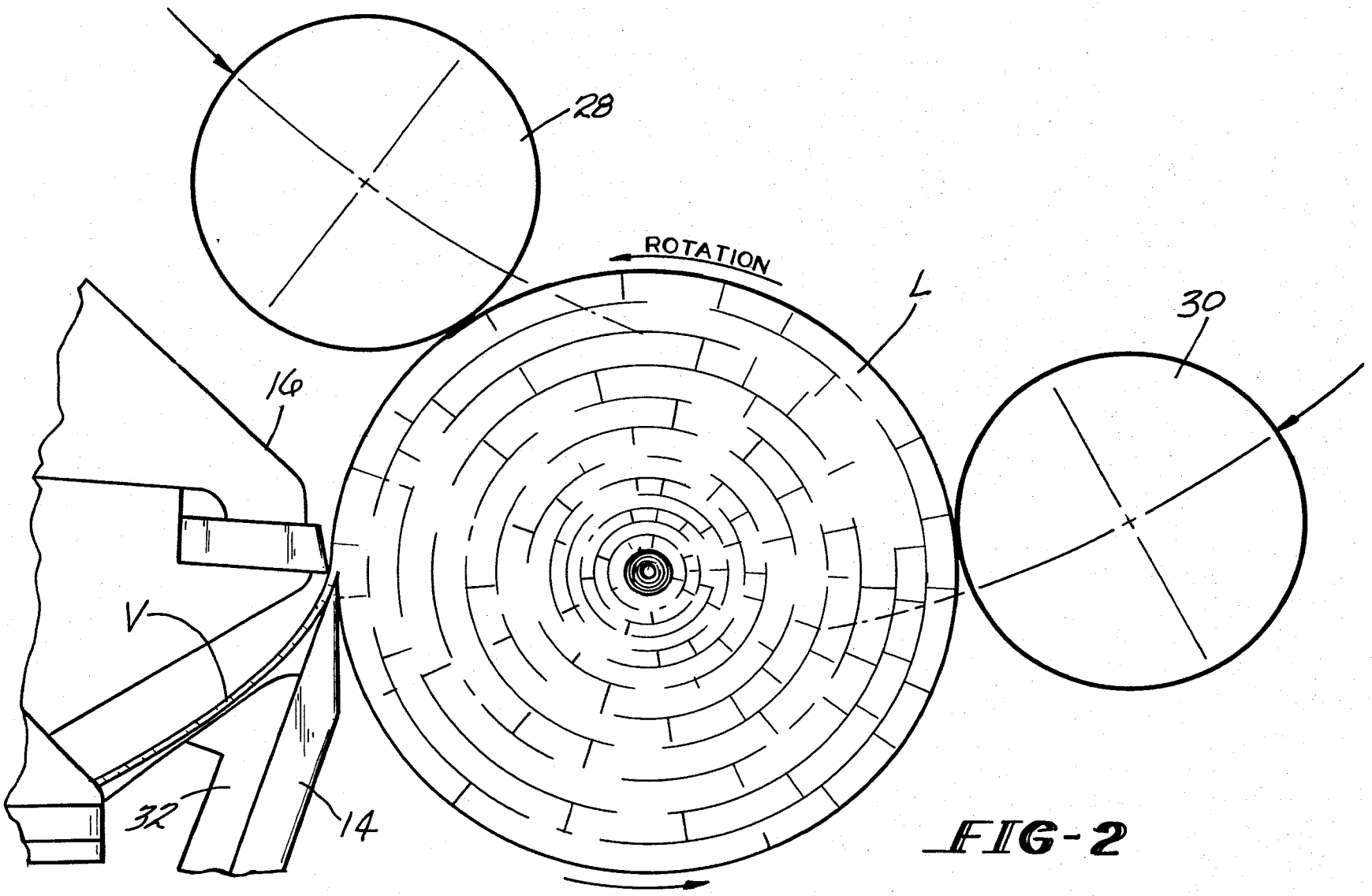
FIG. 2 is a schematic end view of a log as the latter is peeled by the lathe of FIG. 1.

Referring now to FIG. 2, there is shown schematically the manner in which the veneer V is removed while the log L is peeled. The lathe 2 includes a power roll 28 which contacts the outer surface of the log L and which is rotatably driven so as to aid in rotating the log L into the knives 14. The power roll 28 is not shown in FIG. 1 for purposes of clarity. It will be appreciated that the power roll 28 is movably mounted and is steadily advanced toward the log L to maintain contact therewith as the log L is peeled. A guide roll 30 is also included on the lathe to steady the log L as it is rotated. It will be understood that the log L is rotating on the dogs and spindles shown in FIG. 1.

Figure 3:
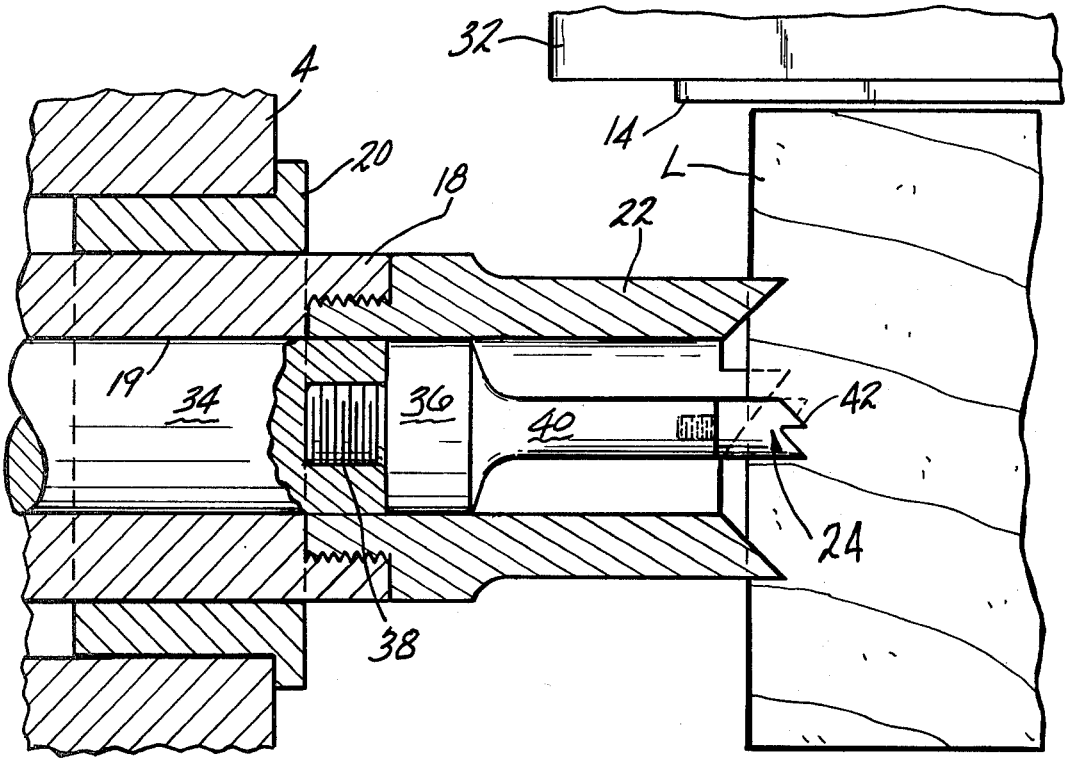
FIG. 3 is a fragmented sectional view of one of the log gripping portions of the lathe of FIG. 1 showing two concentric spindles and dogs with both dogs being in gripping engagement with the end of the log.

Referring now to FIG. 3, a fragmented sectional view of one of the coaxial spindle and dog sets at one end of the lathe is shown. It will be noted that both the outer and inner dogs 22 and 24 respectively are embedded in the log L. The log L is rotating down against the knives 14, which are mounted on a knife backing plate 32. The outer dog 22 is threaded or otherwise secured to the end of the outer spindle 18. It will be noted that the outer spindle 18 is annular in shape and has a bore 19 in which the inner spindle 34 is disposed. The inner dog 24 is threaded or otherwise secured to the end of the inner spindle 34. Both spindles 18 and 34 are journaled and keyed for concurrent rotational movement in the bearing 20. The inner dog 24 includes a basal portion 36 from which a threaded stem 38 projects. The inner dog 24 also includes an elongated shank 40 which projects from the basal portion 36 and which terminates at log-engaging teeth 42. It will be noted that the shank 40 has a smaller diameter than the basal portion 36 and the inner spindle 34. For purposes of illustration, the inner spindle 34 can have an outer diameter of four inches while the inner dog shank 40 has an outer diameter of two and seven-eighths inches. These diameters are used merely for purposes of illustration and can, of course, be varied or changed. It will be noted that the outer dog 22 is formed in accordance with conventional teachings and is slightly smaller than the diameter of the outer spindle 18, which diameter may be, by way of illustration, six and one-half inches. By way of contrast, the inner dog 24 is considerably smaller in diameter than the inner spindle 34 and serves as an extension of the latter.

Figure 4:
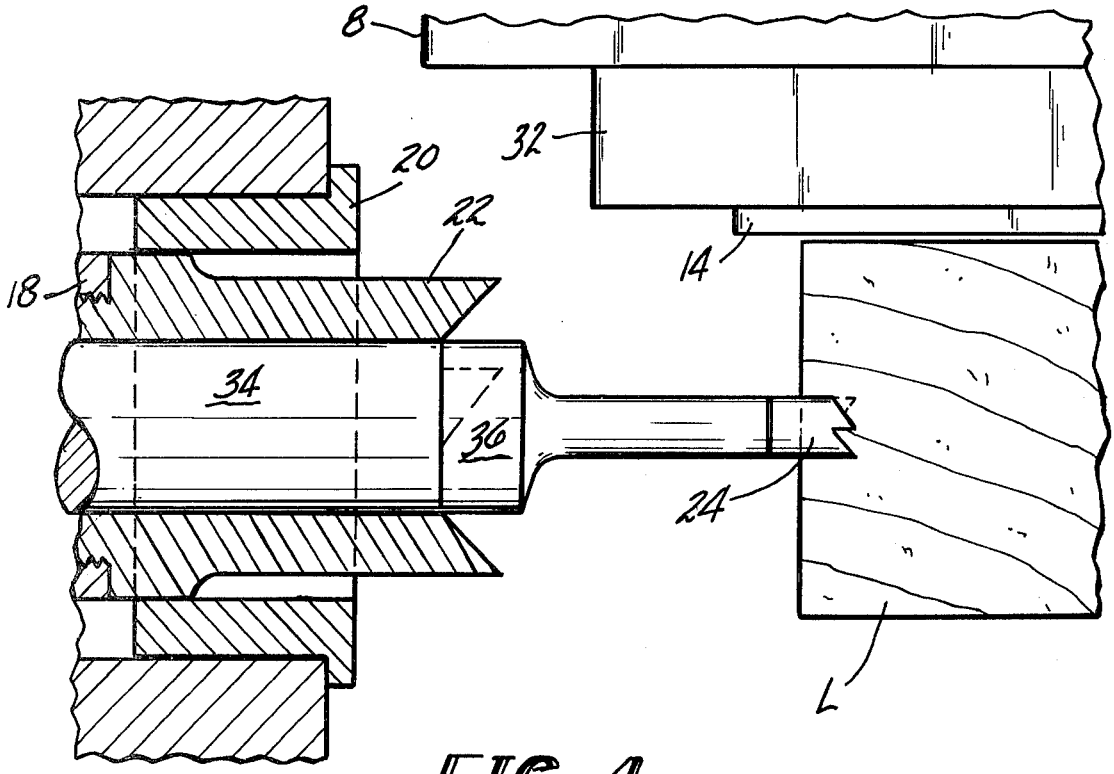
FIG. 4 is a sectional view similar to FIG. 3 but showing the outermost spindle and dog after they have been retracted from the log gripping position as the peeling knives approach the outer diameter of the outermost spindle and dog.

Referring now to FIG. 4, the apparatus is shown as the knives 14 have peeled the log L to an outer diameter which is approaching the outer diameter of the outer spindle 18 and dog 22. At this point the outer spindle 18 and dog 22 are automatically retracted through the bearing 22 away from the log L until the teeth on the outer dog 22 are approximately coplanar with the forward end of the basal portion 36 of the inner dog 24. The inner dog 24 remains in biting engagement with the end of the log L and the peeling of the log L continues.

Figure 5:
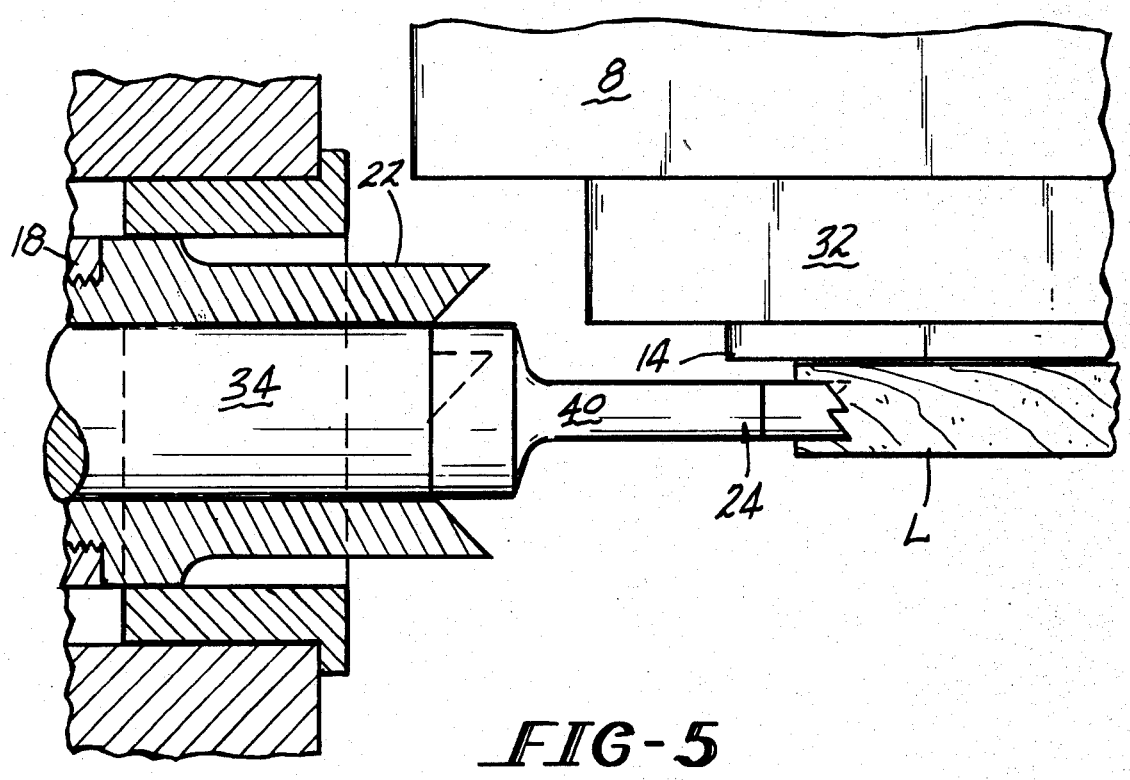
FIG. 5 is a sectional view similar to FIG. 4 but showing the log being peeled down to a core which is slightly larger in diameter than the inner dog.

Referring now to FIG. 5, the apparatus is shown as the log L has been peeled to approximately the diameter of the shank 40 of the inner dog 24. At this point the peeling of the log L stops and the remaining core is removed from the lathe. It will be noted that the retraction of the outer dog 22 and spindle 18 combined with the extent of projection and elongation of the inner dog shank 40 provides enough clearance for the knives 14, knife backing plate 32 and carriage 8 to move in toward the axis of the log L so as to allow the log L to be peeled down to a core which is approximately the same diameter as the inner dog shank 40. It will also be readily apparent that, should the knife advance too far into the log L during peeling, any resulting damage to the lathe would be limited to the inner dog 24 and the knife involved. The spindle 34 would not be damaged. Since the inner dog 24 can be readily removed and replaced, down time of the lathe would be relatively insignificant as compared to a situation where the inner spindle 24 were damaged by contact with a knife.

It will be readily appreciated that this invention permits the peeling of a log to progress to a smaller core without sacrificing the advantages realized from using a relatively large spindle, with the result being a core which is smaller than the spindle on which it is rotatably mounted. This is of particular importance when smaller logs are peeled due to the marked increase in veneer yield obtained. By way of example, Table 1 is presented comparing the yield of veneer in cubic feet when the end core is five inches and when it is three inches.

TABLE 1

| | Percentage Increase in Volume by Peeling on an 8' Lathe to a 3" Core Rather Than Peeling to a 5' Core | | |
|---|---|---|---|
| Diameter of Log | Cu. Ft. Volume of Logs Peeled to 5" Diameter Core | Cu. Ft. Volume of Logs Peeled to 3" Diameter Core | % Increase in Volume |
| 7" | 1.12 | 1.87 | 67% |
| 8" | 1.83 | 2.57 | 41% |
| 9" | 2.62 | 3.37 | 29% |
| 10" | 3.51 | 4.26 | 21% |
| 11" | 4.49 | 5.24 | 17% |
| 12" | 5.57 | 6.32 | 13% |
| 13" | 6.74 | 7.49 | 11% |
| 14" | 8.00 | 8.75 | 9% |
| 15" | 9.36 | 10.11 | 8% |

TABLE 1-continued

| Diameter of Log | Percentage Increase in Volume by Peeling on an 8' Lathe to a 3" Core Rather Than Peeling to a 5' Core: Cu. Ft. Volume of Logs Peeled to 5" Diameter Core | Cu. Ft. Volume of Logs Peeled to 3" Diameter Core | % Increase in Volume |
|---|---|---|---|
| 16" | 10.81 | 11.56 | 7% |
| 17" | 12.35 | 13.10 | 6% |
| 18" | 13.99 | 14.74 | 5% |
| 19" | 15.72 | 16.47 | 5% |
| 20" | 17.55 | 18.30 | 4% |
| 30" | 40.95 | 41.69 | 2% |

Used Smalion's Formula for Cylinder:
$V = .005454 \times D^2$ (inches) $\times$ L (ft.)

This invention thus provides for increased veneer yield without the need for drastically altering existing lathes since only the dogs must be modified. The result is an improved lathe which is not subject to excessive down time should the knives accidentally contact the log supporting portion of the lathe.

Since many changes and variations of the disclosed embodiment of the invention may be made without departing from the inventive concept, it is not intended to limit the invention otherwise than as required by the appended claims.

What is claimed is:

1. A dog for use in a log peeling lathe for supporting the ends of a log being peeled, said dog comprising:
   (a) an enlarged basal portion;
   (b) means on one side of said basal portion for securing said dog to a lathe spindle;
   (c) an elongated shank portion adjacent to said basal portion, said shank portion being smaller in diameter than said basal portion; and
   (d) toothed log-engaging means formed on an end of said shank portion remote from said basal portion, said toothed log-engaging means having a diameter which is substantially no larger than the diameter of said shank portion.

2. A log peeling lathe for peeling logs to form veneer sheet, said lathe comprising:
   (a) a spindle rotatably mounted on said lathe, said spindle providing means for enabling rotational movement of a log during peeling on said lathe, said spindle having a free end and having a predetermined diameter;
   (b) a log-engaging dog removably mounted on said free end of said spindle, said dog having an elongated shank portion extending away from said free end of said spindle, and said shank portion having a diameter which is substantially less than the diameter of said spindle, and said dog comprising a toothed portion formed at an end of said shank, said toothed portion being operable to be embedded in a log mounted on said lathe.

3. The lathe of claim 2 further comprising knife means mounted thereon, said knife means being movable along a path substantially perpendicular to the axis of said dog shank for peeling of a log mounted on the lathe, said spindle being positioned out of the path of movement of said knife means, and at least a portion of said dog shank being disposed in the path of movement of said knife means.

4. The lathe of claim 2, wherein said dog includes a basal portion of substantially the same diameter as said spindle.

5. A log peeling lathe for peeling logs to form veneer sheet, said lathe comprising:
   (a) an outer spindle rotatably mounted on said lathe, said outer spindle having a bore, and said outer spindle being mounted for axial reciprocal movement on the lathe;
   (b) an outer dog mounted on an end of said outer spindle, said outer dog being approximately the same diameter as said outer spindle and having a toothed end for imbedment in a log;
   (c) an inner spindle rotatably mounted on said lathe, said inner spindle being disposed within said bore of outer spindle, and said inner spindle having a diameter which is approximately equal to the diameter of said bore; and
   (d) an inner dog removably mounted on an end of said inner spindle, said inner dog having an elongated shank having a diameter which is substantially smaller than the diameter of said outer spindle bore, said elongated shank having a toothed end for imbedment in a log, said toothed end of said inner dog being approximately coexistant with said toothed end of said outer dog when both of said dogs are embedded in a log.

6. The lathe of claim 5, further comprising knife means mounted thereon, said knife means being movable along a path substantially perpendicular to the axis of said inner dog shank for peeling of a log mounted on the lathe, said inner spindle being positioned out of the path of movement of said knife means, and at least a portion of said inner dog shank being disposed in the path of movement of said knife means.

* * * * *